US008222955B2

(12) United States Patent
Duval et al.

(10) Patent No.: US 8,222,955 B2
(45) Date of Patent: Jul. 17, 2012

(54) COMPENSATED BANDGAP

(75) Inventors: Philippe Duval, Lutry (CH); Yann Johner, Préverenges (CH); Fabien Vaucher, Lausanne (CH)

(73) Assignee: Microchip Technology Incorporated, Chandler, AZ (US)

( * ) Notice: Subject to any disclaimer, the term of this patent is extended or adjusted under 35 U.S.C. 154(b) by 141 days.

(21) Appl. No.: 12/818,887

(22) Filed: Jun. 18, 2010

(65) Prior Publication Data

US 2011/0074495 A1 Mar. 31, 2011

Related U.S. Application Data

(60) Provisional application No. 61/245,908, filed on Sep. 25, 2009.

(51) Int. Cl.
*G05F 1/10* (2006.01)

(52) U.S. Cl. ..... 327/539

(58) Field of Classification Search ..... 323/313, 323/314; 327/534, 535, 537, 539
See application file for complete search history.

(56) References Cited

U.S. PATENT DOCUMENTS

| | | | | |
|---|---|---|---|---|
| 5,291,122 | A | 3/1994 | Audy | 323/313 |
| 6,407,622 | B1 | 6/2002 | Opris | 327/539 |
| 7,602,236 | B2 * | 10/2009 | Jo | 327/539 |
| 7,612,606 | B2 * | 11/2009 | Marinca | 327/539 |

OTHER PUBLICATIONS

Özalevli, E., et al., "Programmable Floating-Gate CMOS Resistors", IEEE International Symposium on Circuits and Systems (ISCAS), XP010816015, 4 pages, May 23, 2005.
Hirose, T., et al., "Ultralow-Power Temperature-Insensitive Current Reference Circuit", 2005 IEEE Sensors, IEEE—Piscataway, NJ; XP010899878, 4 pages, Oct. 31, 2005.
Huang, H., et al., "Piecewise Linear Curvature-Compensated CMOS Bandgap Reference", Electronics, Circuits, and Systems, pp. 308-311, Aug. 31, 2008.
International PCT Search Report and Written Opinion, PCT/US2010/044849, 15 pages, Mailed Feb. 22, 2011.

* cited by examiner

*Primary Examiner* — Jeffrey Zweizig
(74) *Attorney, Agent, or Firm* — King & Spalding L.L.P.

(57) ABSTRACT

An integrated circuit has an untrimmed bandgap generation circuit; and a bandgap generation circuit coupled to the untrimmed bandgap generation circuit. The bandgap generation circuit has a current source controlled by the untrimmed bandgap generation circuit and coupled in series with a resistor and a first bipolar diode device, one or more of bipolar diode devices, each bipolar diode device coupled in parallel with the first bipolar diode device, wherein a trimmed bandgap reference voltage output of the integrated circuit is a function of the number of bipolar diode devices.

21 Claims, 7 Drawing Sheets

COMPENSATED BANDGAP

CROSS-REFERENCE TO RELATED APPLICATIONS

This application claims the benefit of U.S. Provisional Application No. 61/245,908 filed on Sep. 25, 2009, entitled "SIMPLE UNIVERSAL SECOND-ORDER TEMPERATURE COMPENSATION TECHNIQUE FOR BANDGAP CELLS", which is incorporated herein in its entirety.

TECHNICAL FIELD

The technical field of the present application relates to bandgap circuits in general, and more particularly, to bandgap compensation circuits.

BACKGROUND

In analog circuit design, it may be difficult to obtain precise voltages or measurements because analog components have many parameters that vary with process, temperature, and/or or power supplied. Therefore, one or more reference voltages for an integrated circuit may be generated from a bandgap reference voltage circuit. If, however, the bandgap reference voltage is not accurate due to variations in particular of the temperature, then all reference voltages derived from the bandgap reference voltage will also be inaccurate. This could induce substantial errors in the operation of the integrated circuit.

The second order bow of a standard bandgap voltage reference significantly reduces the accuracy of the bandgap voltage over an extended temperature operating range. The second order bow also may add noise on the reference voltage when the bandgap cell is operating at low or high temperatures.

SUMMARY

There exists a need for a less temperature dependent bandgap.

According to an embodiment, a bandgap circuit may comprise a first order compensated bandgap unit generating a first output voltage, and a second order compensation circuit adding a second output voltage to the first output voltage and comprising a first metal oxide semiconductor (MOS) transistor coupled in parallel with a first resistor, wherein the first MOS transistor is biased with an inverse proportional to absolute temperature (PTAT) voltage.

According to a further embodiment, the first order compensated bandgap unit may comprise first and second bipolar transistors. According to a further embodiment, the second order compensation circuit may comprise a first controllable current source whose output is coupled with a reference potential via a diode connected third bipolar transistor connected in series with a diode connected second MOS transistor, wherein the output of the first current source controls said first MOS transistor. According to a further embodiment, a second order compensation voltage may be added by coupling the second order compensation circuit in series with the first order compensated bandgap unit.

According to a first type of embodiments, the first order compensated bandgap unit may comprise a current mirror being coupled with the first and second bipolar transistors, second and third resistors coupled in series between the first bipolar transistor and a reference potential, wherein the second bipolar transistor is connected with a node between the second and third resistor, and an operational amplifier whose inputs are connected with nodes between the current mirror and the first and second bipolar transistors, respectively and whose output controls the first and second bipolar transistors. According to a further embodiment, the current mirror can be formed by MOS transistors. According to a further embodiment, the controllable current source can be formed by a MOS transistor and coupled with the current mirror.

According to another type of embodiments of the bandgap circuit, the first order compensated bandgap unit may comprise a second controllable current source being coupled with the first bipolar transistor via series connected second and third resistors and being coupled with the second bipolar transistor via a fourth resistor, and comprises an operational amplifier having a first input coupled with a node between the second and third resistors and a second input coupled with a node between the fourth resistor and the second bipolar transistor and an output which controls the first and second controllable current sources.

According to yet another type of embodiments of the bandgap circuit, the second order compensation circuit may comprise first and second controllable current sources and a diode connected second MOS transistor connected in series with a diode connected first bipolar transistor between said first controllable current source and a reference potential, wherein the node between the first controllable current source and the MOS transistor controls said first MOS transistor and wherein the second controllable current source is coupled with the parallel coupled first MOS transistor and first resistor. According to a further embodiment, a second order compensation voltage can be added by controlling said bipolar transistors of said first order compensated bandgap unit with the second order compensation voltage. According to a further embodiment, the first order compensated bandgap unit may comprise a third controllable current source coupled with ground through a first branch comprising a series connection of second and third resistors and the first bipolar transistor and through a second branch comprising a series connection of a fourth resistor and the second bipolar transistor, a operational amplifier whose input is coupled with a node between the second and third resistor and a node between the fourth resistor and the second bipolar transistor, wherein an output of the operational amplifier controls said first, second and third current source. According to a further embodiment, the first, second and third controllable current sources can be formed by MOS transistors.

According to another embodiment, a method for generating a reference voltage, may comprise the steps of generating a first order compensated bandgap voltage, and generating a second order compensation voltage using a first metal oxide semiconductor (MOS) transistor coupled in parallel with a first resistor, wherein the first MOS transistor is biased with an inverse proportional to absolute temperature (PTAT) voltage; and adding the second order compensation voltage to the first order compensated bandgap voltage.

According to a further embodiment of the method, the MOS transistor may be operated in the triode region. According to a further embodiment of the method, the second order compensation voltage can be generated by controlling the first MOS transistor with a control signal generated by a controllable current feeding a diode connected third bipolar transistor connected in series with a diode connected second MOS transistor. According to a further embodiment of the method, the second order compensation voltage can be generated by feeding a first current to the parallel coupled first MOS transistor and first resistor and controlling the first MOS transistor by a signal generated by a second current feeding a diode connected second MOS transistor connected in series with a diode connected first bipolar transistor.

According to yet another embodiment, a bandgap circuit may comprise a first order compensated bandgap unit comprising first and second bipolar transistors generating a first output voltage, and a second order compensation circuit adding a second output voltage to the first output voltage and comprising a first metal oxide semiconductor (MOS) transistor coupled in parallel with a first resistor, wherein the first MOS transistor is biased with an inverse proportional to absolute temperature (PTAT) voltage, wherein the second order compensation circuit comprises a controllable current source and a diode connected third bipolar transistor connected in series with a diode connected second MOS transistor between the controllable current source and a reference potential, wherein a voltage created by means of the controllable current source controls the first MOS transistor.

According to a further embodiment of the bandgap circuit, a second order compensation voltage can be added by coupling the second order compensation circuit in series with the first order compensated bandgap unit. According to a further embodiment of the bandgap circuit, the first order compensated bandgap unit may comprise a current mirror being coupled with the first and second bipolar transistors, second and third resistors coupled in series between the first bipolar transistor and a reference potential, wherein the second bipolar transistor is connected with a node between the second and third resistor, and an operational amplifier whose inputs are connected with nodes between the current mirror and the first and second bipolar transistors, respectively and whose output controls the first and second bipolar transistors. According to a further embodiment of the bandgap circuit, the first order compensated bandgap unit may comprise a third controllable current source coupled with ground through a first branch comprising a series connection of second and third resistors and the first bipolar transistor and through a second branch comprising a series connection of a fourth resistor and the second bipolar transistor, a operational amplifier whose input is coupled with a node between the second and third resistor and a node between the fourth resistor and the second bipolar transistor, wherein an output of the operational amplifier controls the first, second and third current source. According to a further embodiment of the bandgap circuit, a second order compensation voltage can be added by controlling the bipolar transistors of the first order compensated bandgap unit with the second order compensation voltage.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to FIGS. 1 through 5 wherein like numbers are used to indicate like and corresponding parts.

Figure 8:
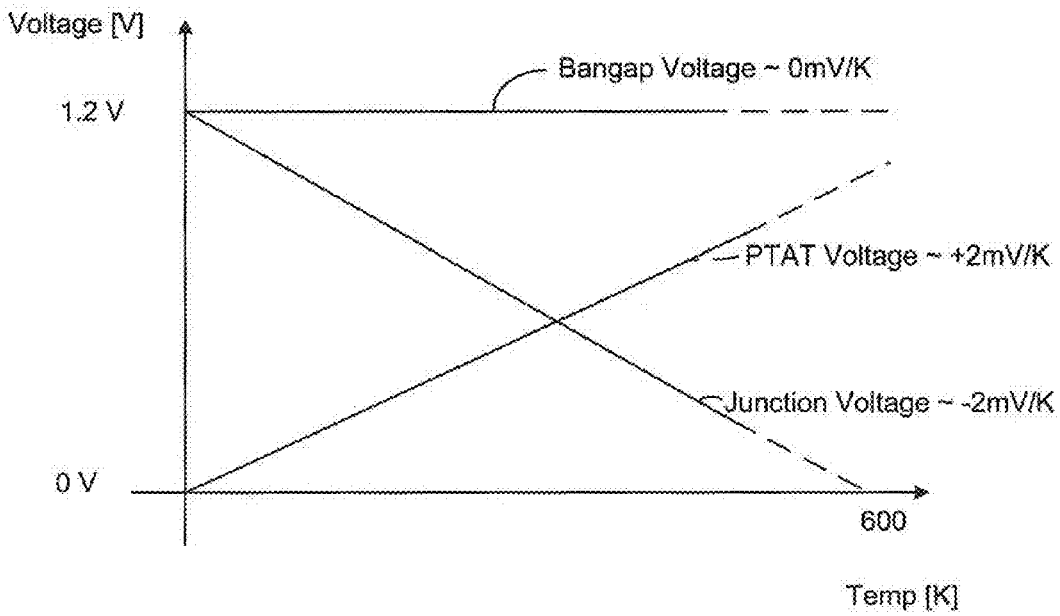

FIG. 8 shows the principle of a conventional bandgap: a PTAT (Proportional To Absolute Temperature) voltage is added to a junction voltage that is equal to the bandgap voltage at OK (absolute zero) and decreases at a rate of 2 mV/K (which is equal to 2 mV/° C.). When the PTAT voltage is equal to 2 mV/K the sum of the diode voltage, $V_{bandgap}$ −2 mv/K, and the PTAT voltage is equal to the bandgap voltage whatever the temperature is.

Figure 6A:
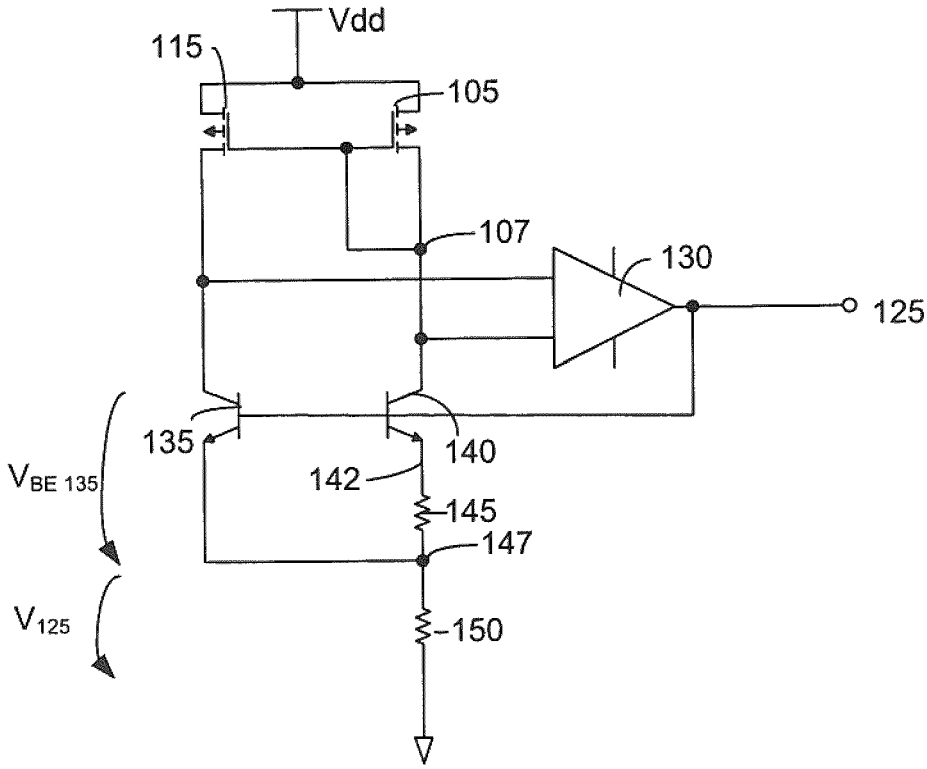
Figure 6a (Prior Art)
FIGS. 6*a* and *b* show conventional bandgap circuits.

FIG. 6*a* illustrates a conventional bandgap generation circuit. Two current sources are formed by current mirror consisting of MOSFET transistors 105 and 115. The first branch of this current mirror includes a first bipolar transistor 140, that has a size of A (A>1), which has its emitter node 142 coupled to ground via two in series connected resistors 145 and 150, its base connected to the output voltage node 125 and its collector connected to a current mirror input node 107. The second branch includes a second bipolar transistor 135, that has a size of 1, which has its emitter node 147 coupled to ground through resistor 150. Thus the emitter of transistor 135 is connected to the mid point 147 between resistors 145 and 150. An operational amplifier is connected to the collectors of the first and second bipolar transistor 140, 135 wherein its output is coupled with the base of both bipolar transistors 135, 140 and with an output terminal 125 carrying the reference output voltage. FIG. 6*a* can be divided into two sections: A PTAT current generator and a PTAT voltage generator.

The PTAT current generator comprises MOS current mirror 105 and 115, the two bipolar 135 and 140, the resistor 145 and amplifier 130. It can be shown that the $1^{st}$ order estimate of current flowing in each branch of the current mirror is equal to $$T*\ln(A)*U_t/R_{145},$$

where T is the absolute temperature in Kelvin, ln(A) is the natural logarithm of A, $U_t$ the thermodynamic voltage is equal to 86 μV, and $R_{145}$ is the value of resistor 145. Since $\ln(A)*U_t/R_{145}$ is a circuit constant that depends on A and $R_{145}$, the current flowing in each branch of the current mirror is proportional to the absolute temperature.

It can be noted that there is a junction voltage, the base emitter junction between the output node 125 and mid resistor point node 147. Thus, the voltage difference between the output node 125 and node 147 decreases by 2 mV/K.

The PTAT voltage is achieved forcing the sum of the two PTAT currents into the resistor 150. The voltage across resistor 150 becomes $2*T*86\ \mu V*\ln(A)*(R_{150}/R_{145})$ where $R_{150}$ is the value of resistor 150. Therefore when the $(R_{150}/R_{145})$ resistor ratio is set to 1 mV/(86 μV*ln(A)), the 2 mV/K PTAT voltage is achieved on node 147.

The voltage on the output node 125 is the sum of bipolar 135 base emitter junction voltage (that decreases by 2 mV/K) with the voltage on node 147. Thus it becomes independent of the temperature when the $(R_{150}/R_{145})$ resistor ratio is set to 1 mV/(86 μV*ln(A)).

In practice both the PTAT current and junction voltage have higher order components that induce the well known bell characteristic of standard bandgap cell. These higher order components induce a few mV variation of the bandgap voltage across the standard −50° C. to 150° C. operating range of the bandgap cell. This isn't an issue for many applications. However when high accuracy is required the bell amplitude needs being minimized. Cancelling the $2^{nd}$ order component (that dominates in higher order components) already dramatically improves the bandgap voltage accuracy over temperature.

Figure 7:
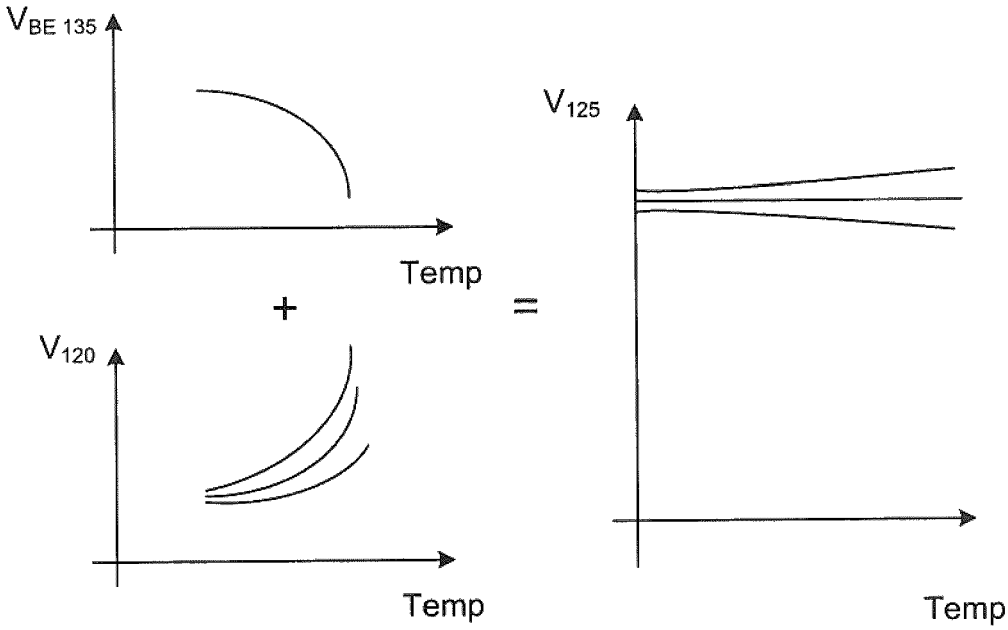
Figure 7 (Prior Art)
FIGS. 7 and 8 illustrate the function of the conventional bandgap.
Figure 6B:
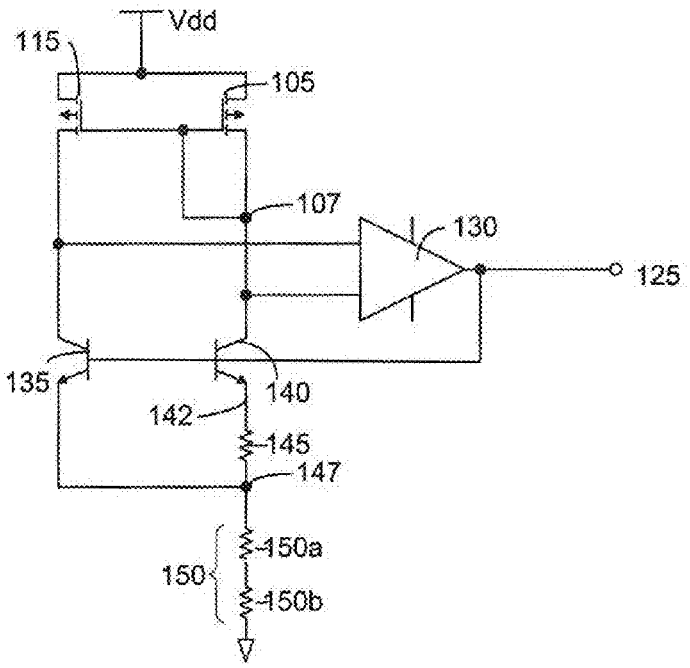
Figure 6b (Prior Art)

The conventional way for cancelling the $2^{nd}$ order component of the bandgap voltage is using a material that has a positive temperature coefficient for $R_{150}$. Unfortunately it's almost impossible having a material that gives the correct positive temperature coefficient for $R_{150}$. Usually the available material has a too high positive temperature coefficient. Thus the $R_{150}$ is realized by a series combination of two different materials resistors $R_{150a}$ and $R_{150b}$ in order to achieve the correct value for the residual temperature coefficient as shown in FIG. 6*b*. But now $R_{150}$ and $R_{145}$ are realized with different material, thus, the accuracy of the $R_{150}/R_{145}$ ratio is dramatically reduced and $R_{150}$ needs to have trimming capability. This trimming impacts the residual value of the $R_{150}$ positive temperature coefficient (as well as process dispersion of this positive temperature coefficient) and, thus, the accuracy of the bell characteristic compensation is reduced as shown in FIG. 7.

The aforementioned problems are solved, and other and further benefits achieved by compensating the typical bow of a bandgap circuit by generating a compensation voltage that has a low first order component with respect to the $2^{nd}$ order component. According to the teachings of this disclosure, a simple and universal solution to bandgap bow may be applied to most types of bandgap circuit architectures, and may be applied to existing bandgap cells with only minor modifications thereto by adding a small amplitude (10-20 mV maximum) concave voltage to the initial bandgap voltage for compensating its second order convex behavior.

According to various embodiments, this can be achieved by using a MOS device operated in the triode region. A MOS device used in the triode region has its gate voltage biased by an inverse PTAT voltage. Thus its "on" resistance dramatically increases with the temperature. This emulates a very high positive temperature coefficient for the "on" resistor. Biasing the resistor with a PTAT current generates a voltage that has a prominent $2^{nd}$ order component.

As mentioned above, such a concave ($2^{nd}$ order) voltage can be achieved, for example, through a metal oxide semiconductor (MOS) transistor used as variable resistance versus temperature. The gate voltage of the MOS transistor device is biased via an inverse Proportional To Absolute Temperature (PTAT) voltage, thereby inducing a concave behavior of the "on resistance" with the temperature which mostly comprises a second order components. This concave behavior induces a concave voltage drop on the "on resistance" that dramatically reduces the initial second order convex behavior of the bandgap cell. In practice the induced concave voltage has too much gain at high temperature. This is why it is used in parallel with a standard resistance that clamps the gain at high temperatures.

Figure 1:
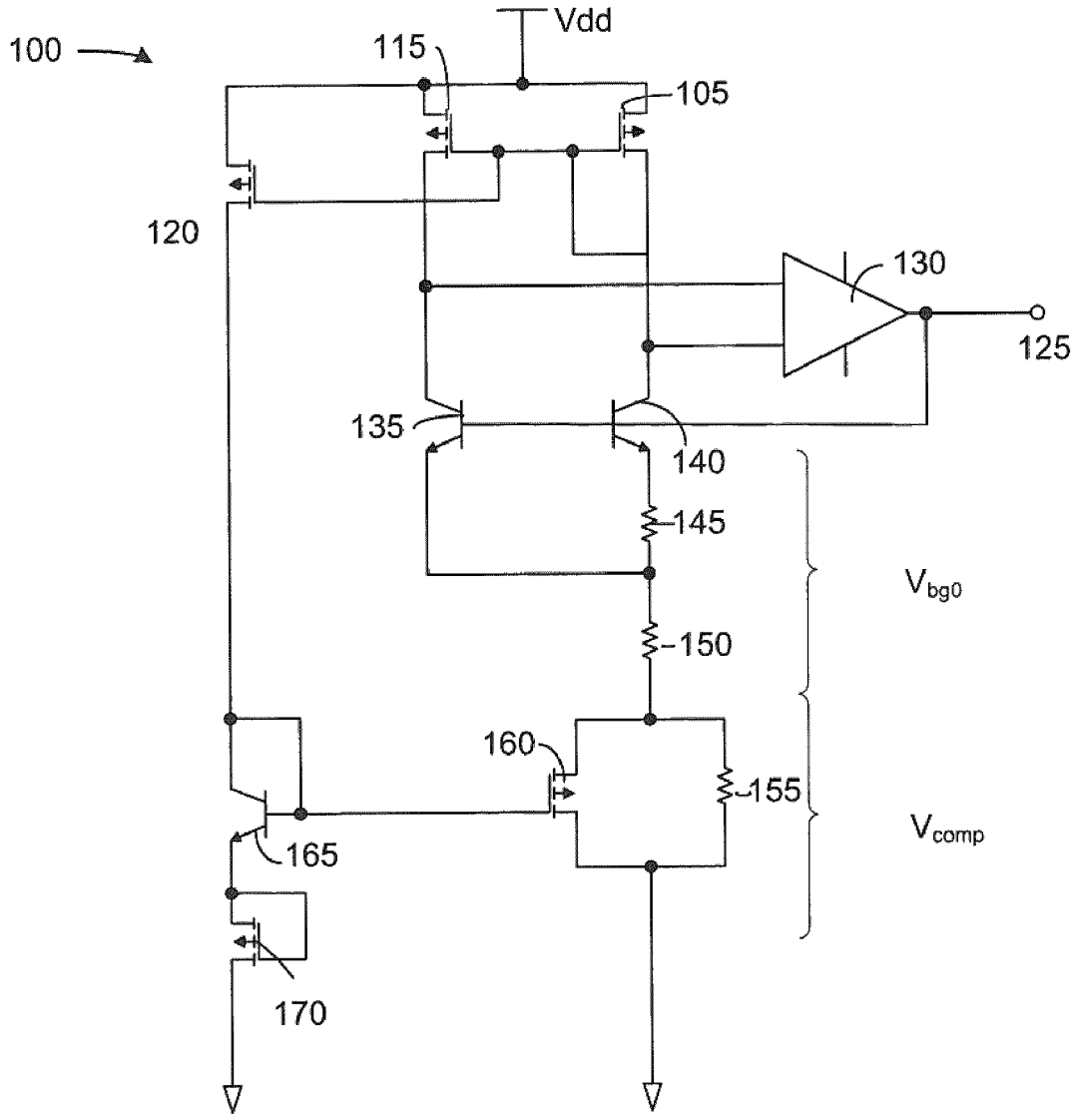
FIG. 1 shows a bandgap circuit according to a first embodiment.

FIG. 1 shows a conventional bandgap circuit as shown in FIG. 6 with an additional compensation circuit. The compensation circuit comprises an additional resistor 155 connected in series with resistor 150. Parallel to resistor 155, a MOSFET transistor 160 is coupled. The gate of this MOSFET transistor 160 is coupled with the base and collector of another bipolar transistor 165 which is fed by another current source formed by MOSFET 120 which is coupled in parallel with MOSFET 115. Furthermore, another MOSFET 170 couples bipolar transistor 165 with ground. The gate of MOSFET 170 is coupled with the node between bipolar transistor 165 and MOSFET 170. corresponding parts. According to other embodiments, devices 165 and 170 do not need to be coupled in the order shown in FIG. 1 but may be swapped.

Figure 2A:
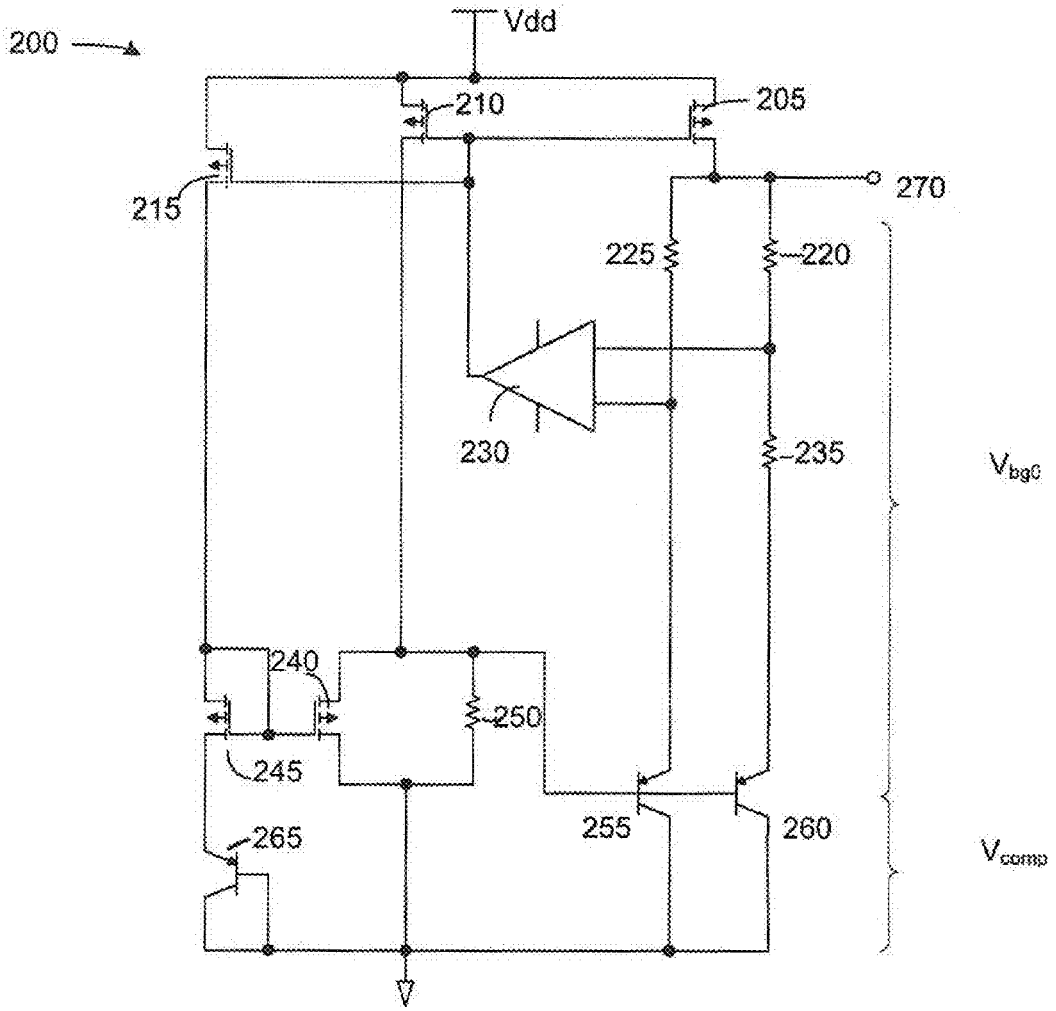
FIGS. 2*a* and *b* shows further embodiments of a bandgap circuit.

FIG. 2*a* shows another standard bandgap cell with the added compensation circuit as introduced in FIG. 1. This circuit comprises MOSFET transistors 205, 210, and 215 coupled with a voltage source Vdd. MOSFET 205 is coupled with the output terminal 270 and with a series of resistors 220 and 235 and bipolar transistor 260 with ground. Furthermore MOSFET 205 is coupled via a second branch including resistor 225 and bipolar transistor 255 with ground. Operation amplifier 230 is coupled on its input side with the node between resistors 220 and 235 and the node between resistor 225 and bipolar transistor 255, respectively. The output of operational amplifier 230 controls the three MOSFETs 205, 210, and 215. MOSFET 210 is coupled with ground via resistor 250 coupled in parallel with MOSFET 240. The node between MOSFET 210 and parallel coupled bipolar transistor 240 and resistor 250 controls the bases of bipolar transistors 255 and 260. MOSFET 215 is coupled with ground via MOSFET 245 coupled in series with bipolar transistor 265. The base of bipolar transistor 265 is coupled with ground and the gate of MOSFET 245 is coupled with the gate of MOSFET 240 and with MOSFET 215.

Usually the there is no access to the collector of vertical PNP devices 255 and 260 since the substrate is their collector. This is why the compensation voltage needs being applied through their base terminal. But the base current of vertical PNP transistor 255 and 260 is usually very small compared to their emitter current. Moreover, the base current has a strong temperature dependency (usually it decreases with the temperature) and has dispersion over process. This renders the compensation inefficient without an external bias current. This is why the extra bias source 210 is required with such devices.

Figure 2B:
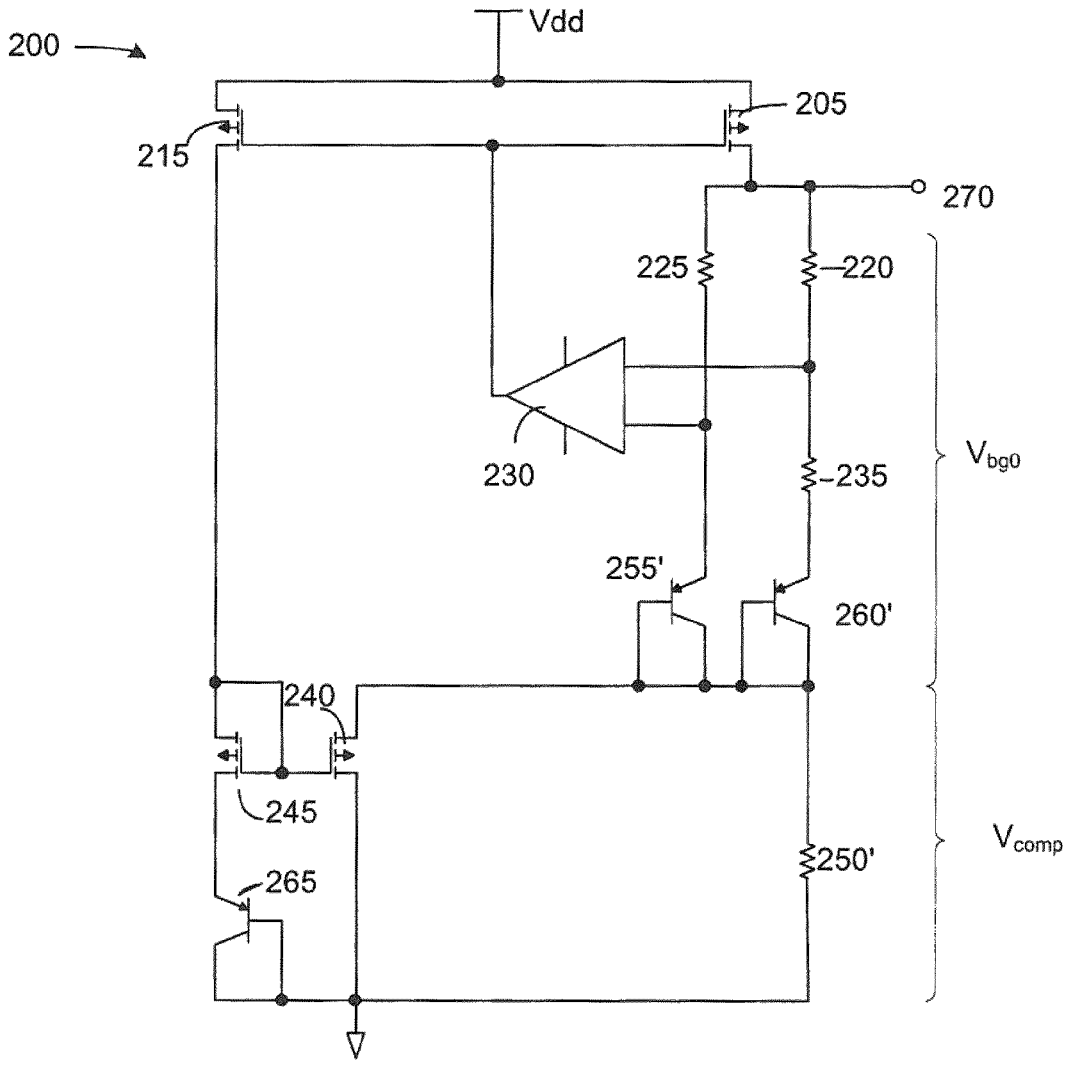

However, when floating bipolar (or diode) devices are available, the compensation circuit can be connected as shown in FIG. 2*b* and the extra bias source 210 is no longer required. Also, resistor 250 and transistors 255 and 260 are replaced by resistor 250' and transistors 255', 260'. The base and collector of transistors 255' and 260' are now connected and coupled with MOSFET 240 and through resistor 250' with ground. Otherwise, the circuit remains the same as shown in FIG. 2*a*.

The gate voltage of MOSFET transistor 160 in FIG. 1 and MOSFET 240 in FIGS. 2*a, b* is biased via an inverse PTAT voltage inducing a PTAT behavior of its "on" resistance. Biasing this PTAT resistor with a PTAT current induces a concave voltage drop on the "on resistance" that dramatically reduces the initial second order convex behavior of the bandgap circuit. In practice the induced concave voltage has too much gain at high temperature. Therefore, it is used in parallel with a standard resistance that clamps the gain at high temperatures. The bandgap voltage variation over temperature can be improved by a factor of three to ten using this technique. No calibration is required in conjunction with this convex compensation method. The inverse PTAT voltage may be generated through the serial combination of the MOSFET transistor 170 (in FIG. 1) or MOSFET 245 (in FIG. 2) that generates the initial voltage and bipolar transistor 165 (in FIG. 1) or bipolar transistor 265 (in FIG. 2) that generates the effective inverse PTAT component. The concave compensation has a first order well controlled term that may be cancelled in the overall bandgap voltage reducing accordingly the gain of the PTAT loop. Ultimately the overall first order can be trimmed to achieve the lowest possible temperature dependence of the bandgap cell.

FIG. 1 (FIGS. 2*a, b*) shows local biasing for devices 165 and 170 (devices 245 and 265). These devices can be biased from an external bias source as well. However the inverse PTAT voltage may be less accurate when devices 165 and 170 (devices 245 and 265) are biased through an external source. When the bandgap cell has to deliver a current to an external load, such external biasing may become mandatory for FIGS. 2*a* and 2*b* topology.

Figure 3:
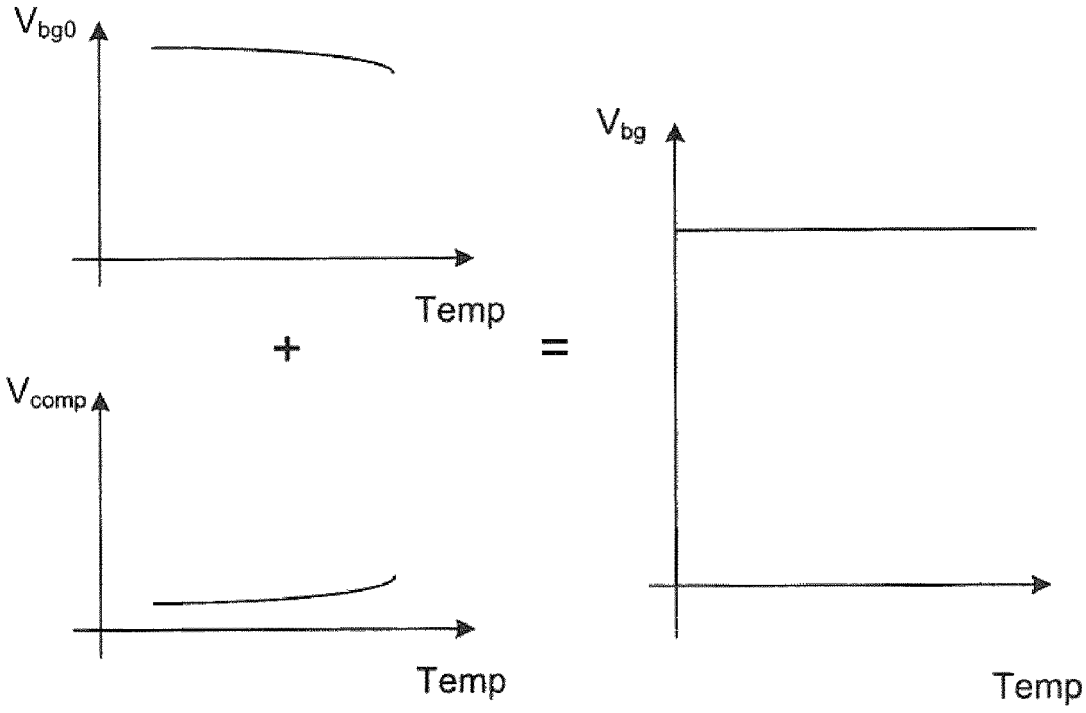
FIG. 3 illustrates the function of the different embodiments.
Figure 4:
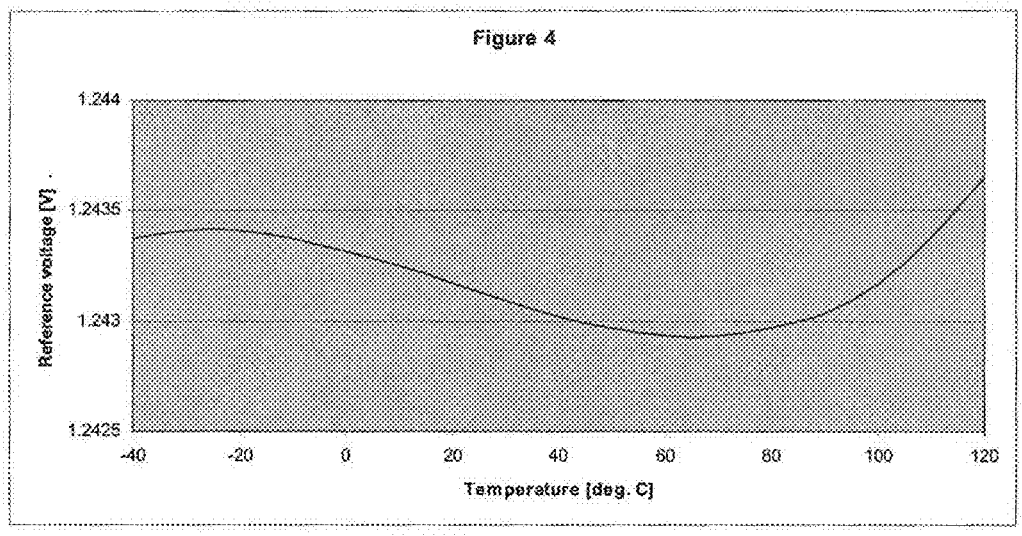
FIG. 4 is a first graph showing simulated reference voltage vs. temperature of the circuit shown in FIG. 1.
Figure 5:
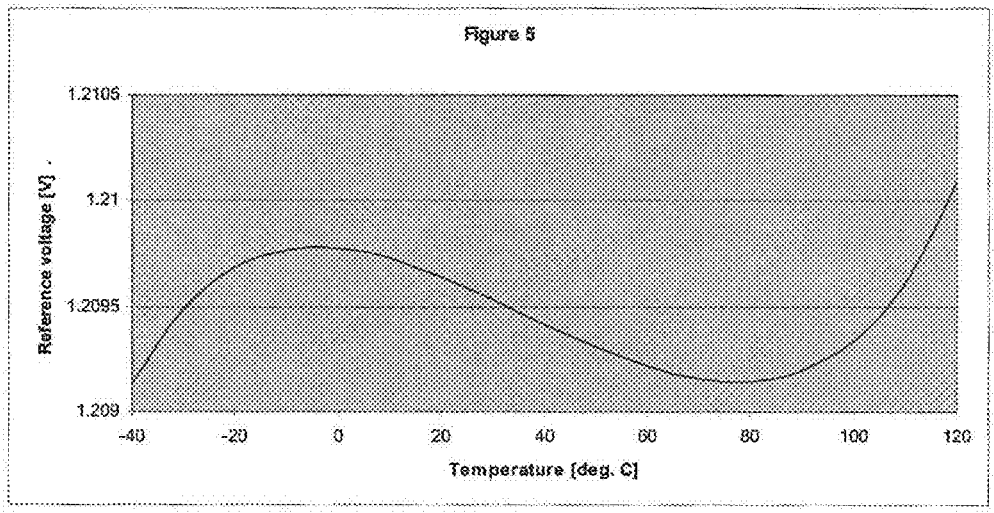
FIG. 5 is a second graph showing simulated reference voltage vs. temperature of the circuit shown in FIG. 2*a;*

FIGS. 1 and 2 also indicate the bandgap voltage Vbg0 and the $2^{nd}$ order compensation voltage Vcomp. The associated curves over the temperature for these voltages are shown in FIG. 3 as well as the theoretical resulting bandgap reference voltage. Simulated resulting reference output voltages over the temperature are shown in FIG. 4 for the circuit according to FIG. 1 and in FIG. 5 for the circuit as shown in FIG. 2*a*.

While embodiments of this disclosure have been depicted, described, and are defined by reference to example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure.

What is claimed is:

1. A bandgap circuit, comprising:

a first order compensated bandgap unit generating a first output voltage, and a second order compensation circuit adding a second output voltage to said first output voltage and comprising a first metal oxide semiconductor (MOS) transistor coupled in parallel with a first resistor, wherein the first MOS transistor is biased with an inverse proportional to absolute temperature (PTAT) voltage.

2. The bandgap circuit according to claim 1, wherein the first order compensated bandgap unit comprises first and second bipolar transistors.

3. The bandgap circuit according to claim 2, wherein the second order compensation circuit comprises a first controllable current source whose output is coupled with a reference potential via a diode connected third bipolar transistor connected in series with a diode connected second MOS transistor, wherein the output of the first current source controls said first MOS transistor.

4. The bandgap circuit according to claim 3, wherein a second order compensation voltage is added by coupling the second order compensation circuit in series with the first order compensated bandgap unit.

5. The bandgap circuit according to claim 4, wherein the first order compensated bandgap unit comprises a current mirror being coupled with the first and second bipolar transistors, second and third resistors coupled in series between the first bipolar transistor and a reference potential, wherein the second bipolar transistor is connected with a node between the second and third resistor, and an operational amplifier whose inputs are connected with nodes between the current mirror and the first and second bipolar transistors, respectively and whose output controls the first and second bipolar transistors.

6. The bandgap circuit according to claim 5, wherein the current mirror is formed by MOS transistors.

7. The bandgap circuit according to claim 5, wherein the controllable current source is formed by a MOS transistor and coupled with the current mirror.

8. The bandgap circuit according to claim 3, wherein the first order compensated bandgap unit comprises a second controllable current source being coupled with the first bipolar transistor via series connected second and third resistors and being coupled with the second bipolar transistor via a fourth resistor, and comprises an operational amplifier having a first input coupled with a node between the second and third resistors and a second input coupled with a node between the fourth resistor and the second bipolar transistor and an output which controls the first and second controllable current sources.

9. The bandgap circuit according to claim 2, wherein the second order compensation circuit comprises first and second controllable current sources and a diode connected second MOS transistor connected in series with a diode connected third bipolar transistor between said first controllable current source and a reference potential, wherein the node between the first controllable current source and the second MOS transistor controls said first MOS transistor and wherein the second controllable current source is coupled with the parallel coupled first MOS transistor and first resistor.

10. The bandgap circuit according to claim 9, wherein a second order compensation voltage is added by controlling said bipolar transistors of said first order compensated bandgap unit with the second order compensation voltage.

11. The bandgap circuit according to claim 9, wherein the first order compensated bandgap unit comprises a third controllable current source coupled with ground through a first branch comprising a series connection of second and third resistors and the first bipolar transistor and through a second branch comprising a series connection of a fourth resistor and the second bipolar transistor, an operational amplifier whose inputs are coupled with a node between the second and third resistor and a node between the fourth resistor and the second bipolar transistor, wherein an output of the operational amplifier controls said first, second and third current source.

12. The bandgap circuit according to claim 11, wherein the first, second and third controllable current sources are formed by MOS transistors.

13. A method for generating a reference voltage, comprising the steps of:

generating a first order compensated bandgap voltage, and generating a second order compensation voltage using a first metal oxide semiconductor (MOS) transistor coupled in parallel with a first resistor, wherein the first MOS transistor is biased with an inverse proportional to absolute temperature (PTAT) voltage; and adding the second order compensation voltage to the first order compensated bandgap voltage.

14. The method according to claim 13, wherein the MOS transistor is operated in the triode region.

15. The method according to claim 13, wherein the second order compensation voltage is generated by controlling the first MOS transistor with a control signal generated by a controllable current feeding a diode connected third bipolar transistor connected in series with a diode connected second MOS transistor.

16. The method according to claim 13, wherein the second order compensation voltage is generated by feeding a first current to said parallel coupled first MOS transistor and first resistor and controlling the first MOS transistor by a signal generated by a second current feeding a diode connected second MOS transistor connected in series with a diode connected first bipolar transistor.

17. A bandgap circuit, comprising:

a first order compensated bandgap unit comprising first and second bipolar transistors generating a first output voltage, and a second order compensation circuit adding a second output voltage to said first output voltage and comprising a first metal oxide semiconductor (MOS) transistor coupled in parallel with a first resistor, wherein the first MOS transistor is biased with an inverse proportional to absolute temperature (PTAT) voltage, wherein the second order compensation circuit comprises a first controllable current source and a diode connected third bipolar transistor connected in series with a diode connected second MOS transistor between said first controllable current source and a reference potential, wherein a voltage created by means of the first controllable current source controls said first MOS transistor.

18. The bandgap circuit according to claim 17, wherein a second order compensation voltage is added by coupling the second order compensation circuit in series with the first order compensated bandgap unit.

19. The bandgap circuit according to claim 17, wherein the first order compensated bandgap unit comprises a current mirror being coupled with the first and second bipolar transistors, second and third resistors coupled in series between the first bipolar transistor and a reference potential, wherein the second bipolar transistor is connected with a node between the second and third resistor, and an operational amplifier whose inputs are connected with nodes between the current mirror and the first and second bipolar transistors, respectively and whose output controls the first and second bipolar transistors.

20. The bandgap circuit according to claim 17, wherein the second order compensation circuit comprises a second controllable current source coupled with the parallel coupled first MOS transistor and first resistor and the first order compensated bandgap unit comprises a third controllable current source coupled with ground through a first branch comprising a series connection of second and third resistors and the first bipolar transistor and through a second branch comprising a series connection of a fourth resistor and the second bipolar transistor, an operational amplifier whose input are coupled with a node between the second and third resistor and a node between the fourth resistor and the second bipolar transistor, wherein an output of the operational amplifier controls said first, second and third current sources.

21. The bandgap circuit according to claim 17, wherein a second order compensation voltage is added by controlling said bipolar transistors of said first order compensated bandgap unit with the second order compensation voltage.

* * * * *